US011473489B2

(12) United States Patent
Pavey et al.

(10) Patent No.: US 11,473,489 B2
(45) Date of Patent: Oct. 18, 2022

(54) FAN COWLING ASSEMBLY

(71) Applicant: J. C. Bamford Excavators Limited, Uttoxeter (GB)

(72) Inventors: Stephen Pavey, Uttoxeter (GB); Ian Parry-Jones, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 43 days.

(21) Appl. No.: 17/073,391

(22) Filed: Oct. 18, 2020

(65) Prior Publication Data

US 2021/0115836 A1 Apr. 22, 2021

(30) Foreign Application Priority Data

Oct. 18, 2019 (GB) ..... 19151232

(51) Int. Cl.

| | |
|---|---|
| ***B60K 11/04*** | (2006.01) |
| ***F01P 5/06*** | (2006.01) |
| ***F01P 11/10*** | (2006.01) |
| ***F04D 29/64*** | (2006.01) |
| *F04D 29/32* | (2006.01) |

(52) U.S. Cl.
CPC ..... *F01P 5/06* (2013.01); *F04D 29/646* (2013.01); *F01P 2070/50* (2013.01); *F04D 29/326* (2013.01)

(58) Field of Classification Search
CPC .. B60K 11/04; B60K 11/06; F01P 5/06; F01P 11/10; F01P 5/02; F01P 1/06
See application file for complete search history.

(56) References Cited

U.S. PATENT DOCUMENTS

| | | | | |
|---|---|---|---|---|
| 4,213,426 | A | 7/1980 | Longhouse | |
| 4,398,508 | A | 8/1983 | Moon et al. | |
| 4,522,160 | A | 6/1985 | Speers et al. | |
| 10,458,309 | B2 * | 10/2019 | Seto | F04D 25/04 |
| 2010/0206526 | A1 * | 8/2010 | Yabe | B60K 11/04 165/121 |
| 2014/0193248 | A1 * | 7/2014 | Johnson | F04D 27/008 415/191 |
| 2016/0327058 | A1 * | 11/2016 | Tyler | F04D 19/002 |
| 2018/0258831 | A1 * | 9/2018 | Seto | F04D 29/601 |
| 2020/0003062 | A1 * | 1/2020 | Ishii | F01D 5/3061 |

FOREIGN PATENT DOCUMENTS

| | | | |
|---|---|---|---|
| CN | 106468289 | A | 3/2017 |
| GB | 2427899 | A | 1/2007 |
| KR | 101 039 670 | B1 | 6/2011 |

OTHER PUBLICATIONS

Search Report for GB 1915123.2, dated Mar. 5, 2020.
Extended European Search Report for EP 20202135.8, dated Dec. 18, 2020.

* cited by examiner

*Primary Examiner* — Long T Tran
(74) *Attorney, Agent, or Firm* — Marshall, Gerstein & Borun LLP

(57) ABSTRACT

A fan cowling assembly for mounting to a working machine, the fan cowling assembly including: a support for mounting to a working machine, the support defining an opening for receiving a plurality of rotatable blades of a fan, in use; a fan ring mounted to the support by a ring mounting arrangement, the fan ring being arranged to surround the plurality of rotatable blades, in use; wherein the ring mounting arrangement is configured such that the fan ring is moveable relative to the support when mounted thereto.

20 Claims, 7 Drawing Sheets

FAN COWLING ASSEMBLY

FIELD OF THE INVENTION

The present invention relates to a fan cowling assembly, a fan assembly, an engine assembly including a fan assembly, and a working machine.

BACKGROUND OF THE INVENTION

In working machines, for example excavators or telehandlers, heat exchangers are commonly provided for various functions such as cooling the engine. The heat exchanger, e.g. a radiator, may be located in an engine compartment of the working machine in combination with a fan for driving air over the heat exchanger. The fan includes a cowling having an opening, and a fan ring is connected to the cowling near the opening to encircle the blades of the fan. In order to maximize the air flow over the heat exchanger, the spacing between the fan ring and the fan blades is kept to a minimum.

Since minimizing fan-fan ring clearance maximizes cooling efficiency, many vehicles run the risk of contact between the fan blades and the fan ring, for example during sudden movement of the vehicle such as a kerb-drop or off-road tracking. Working machines having no suspension can be particularly susceptible to contact between the fan ring and fan blades occurring.

In order to mitigate contact between the fan and the fan ring, working machine designs often use large clearances therebetween, to the detriment of cooling performance. Additionally, in order to account for build tolerances in the working machine, fan rings and cowlings are typically connected via adjustable fixed fasteners, which can be a time intensive process.

The present invention seeks to overcome or at least mitigate one or more problems associated with the prior art.

SUMMARY OF THE INVENTION

A first aspect of the invention provides a fan cowling assembly for mounting to a working machine, wherein the fan cowling assembly comprises:

a support for mounting to a working machine, the support defining an opening for receiving a plurality of rotatable blades of a fan, in use;

a fan ring mounted to the support by a ring mounting arrangement, the fan ring being arranged to surround the plurality of rotatable blades, in use, wherein the ring mounting arrangement is configured such that the fan ring is moveable relative to the support when mounted thereto.

When a fan is mounted to the fan assembly, and the assembly is mounted to a working machine, sudden movement of the machine can cause relative movement between the fan blades and the fan ring. Advantageously, the above arrangement means that, when the fan moves sufficiently to contact the fan ring, the moveable fan ring can be pushed out of the way by the moving fan, which works to reduce the damage to both the fan blades and the fan ring during the collision. In exemplary embodiments, the ring mounting arrangement may be configured such that the position of the fan ring may be fixed relative to the support unless an external force is applied.

Optionally, the ring mounting arrangement may be configured such that the position of the fan ring may be fixed relative to the support unless an external force above a pre-determined threshold is applied.

These arrangements help to reduce movement of the fan ring relative to the support under its own weight during normal driving of the working machine.

In exemplary embodiments, the ring mounting arrangement may be configured such that a force applied to mount the fan ring to the support may be pre-set prior to installation of the fan ring.

Optionally, the fan ring mounting arrangement may comprise a fastener configured to apply a pre-determined force to mount the fan ring to a shroud.

This ensures a consistent resistance to movement of the fan ring is achieved, irrespective of the torque or load applied to the mounting arrangement during assembly thereof.

The apparatus may further comprise a biasing arrangement configured to moveably connect the fan ring to the support.

The use of a biasing arrangement allows the fan ring to be secured to the support whilst allowing for relative movement therebetween. The biasing element may be selected so as to prevent the fan ring moving under its own weight.

Optionally, the biasing arrangement may be configured to frictionally mount the fan ring to the support.

The provision of a friction mounting arrangement allows the connecting means to ensure that the fan ring does not move relative to the support until an external force above a predetermined threshold is applied.

Optionally, the biasing arrangement may comprise a resilient element, e.g. a spring, for biasing the fan ring into frictional engagement with the support.

The use of a resilient biasing element allows force applied to the fan ring to be pre-selected to suit the application.

In exemplary embodiments, a ring mounting arrangement may comprise a clamping member and a portion of the fan ring may be interposed between said clamping member and the shroud, and wherein the biasing arrangement may be configured to clamp the fan ring between the clamping member and support.

The ring mounting arrangement may comprise a shoulder fastener having a head at a first end thereof and a cylindrical portion extending from said head portion, the cylindrical portion having a threaded portion spaced apart from the head for securing the fastener to the support, wherein a resilient element extends between the head and the threaded portion for mounting the fan ring to the support.

This arrangement provides a consistent repeatable compression of the resilient element, as it is determined by the spacing between the head and the threaded portion. Thus, this arrangement pre-determines the mounting/biasing force applied for a given resilient element.

Optionally, the fan ring may be resiliently mounted to the support.

The initial movement of the fan ring after the initial contact moves the impacted part of the ring away from the fan blades. An opposing part of the fan ring will then move towards the rotating fan rings. Advantageously, this rebounding of the fan ring works to re-center the fan ring.

Optionally, the fan ring may be moveable relative to the support up to a pre-determined distance.

The fan ring may be moveable relative to the support by a distance in the range of 10 mm to 20 mm.

The fan ring may be moveable relative to the support by a distance of approximately 15 mm.

In exemplary embodiments, the support may be defined by a bulkhead and a shroud, and the fan ring may be movably mounted to the shroud.

This arrangement minimizes the mass of the fan ring of the assembly and may therefore allow a reduced force to hold the fan ring in a desired position.

A second aspect of the invention provides a fan assembly for cooling a working machine, the fan assembly comprising:

a fan cowling assembly according to a first aspect of the present invention and further comprising:

a fan comprising an impeller and a drive means for rotating the impeller, the impeller comprising a plurality of rotating blades, wherein the fan ring surrounds the plurality of rotating blades.

Optionally, the plurality of rotating blades may define an outer perimeter, and wherein the fan assembly may define a spacing between said outer perimeter and a radially inner surface of the fan ring.

The spacing may be in the range of 6 mm to 10 mm.

The spacing may be approximately 8 mm.

This helps to reduce the likelihood of collisions occurring between the fan ring and the fan blades, whilst mitigating reduction in airflow through the fan assembly. Thus, this arrangement helps to reduce damage occurring to the shroud and the fan, while ensuring sufficient airflow through the fan assembly.

A third aspect of the invention provides engine assembly for a working machine, the engine assembly comprising:

a prime mover;

a heat exchanger; and a fan assembly according to the second aspect of the present invention, wherein the fan assembly is configured to propel air over the heat exchanger and over the prime mover for cooling the prime mover.

Optionally, the fan may be mounted to the prime mover by a fan mounting arrangement.

Optionally, the fan mounting arrangement may comprise one or more anti-vibration mounts.

A fourth aspect of the invention provides a working machine element comprising:

a body;

a working arm connected to the body; and a drive arrangement for propelling the working machine, the drive arrangement comprising an engine assembly according to the third aspect of the present invention.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
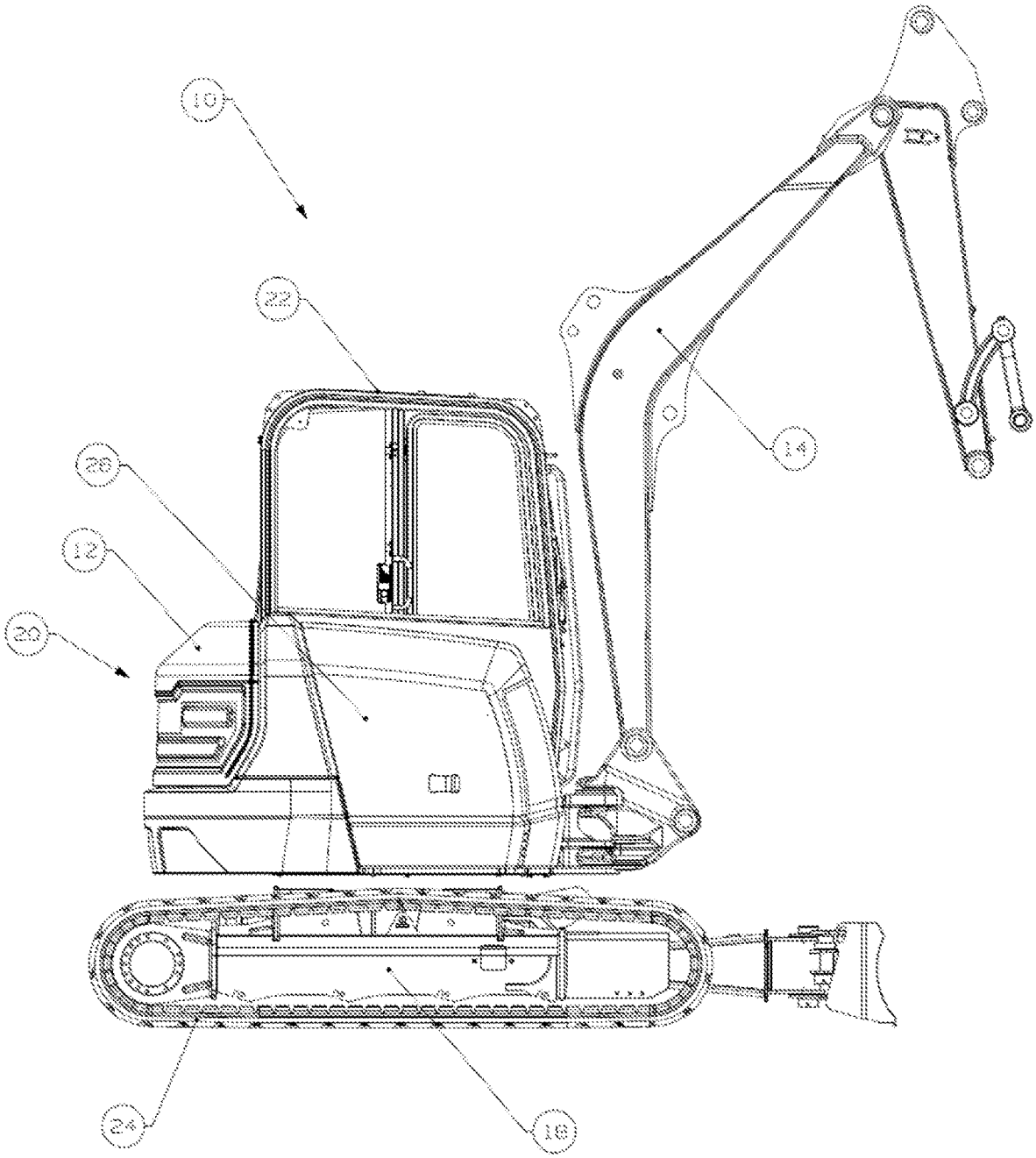
FIG. 1 is a schematic side view of a working machine according to an embodiment.

Referring firstly to FIG. 1, a working machine is illustrated and is indicated generally at 10. The working machine 10 includes a body 12 and a working arm 14 connected to the body 12. The working arm 14 is provided on the working machine 10 for carrying out working operations and includes a working implement, such as a bucket or breaker (not shown) mounted at the distal end thereof.

The working machine 10 includes an undercarriage 18 and a superstructure 20. In the arrangement shown, the superstructure 20 is rotatably mounted on the undercarriage 18, for example via a slew ring. A cab 22 from which an operator can operate the working machine 10 is provided on the superstructure 20.

It will be appreciated that whilst the illustrated working machine 10 is an excavator, the working machine 10 could be any machine including a hydraulically driven or engine mounted fan. Examples of such machines are dumper vehicles, telehandlers, backhoe loaders, cranes, tractors, loading shovels or the like.

The working machine 10 includes a ground engaging structure 24 in the form of tracks. In alternative arrangements the working machine 10 may be provided with wheels. The working machine 10 includes a drive arrangement for driving the ground engaging structure 24 in order to propel the working machine 10. The drive arrangement is provided within an engine compartment 26 of the working machine 10. As will be discussed in more detail below, the drive arrangement includes an engine assembly for driving the ground engaging structure (i.e. propelling the working machine 10), and a fan assembly for cooling the engine assembly. In some arrangements, the drive arrangement may also be configured for controlling (i.e. operating) the working arm 14 and the associated working implement 16.

Figure 2:
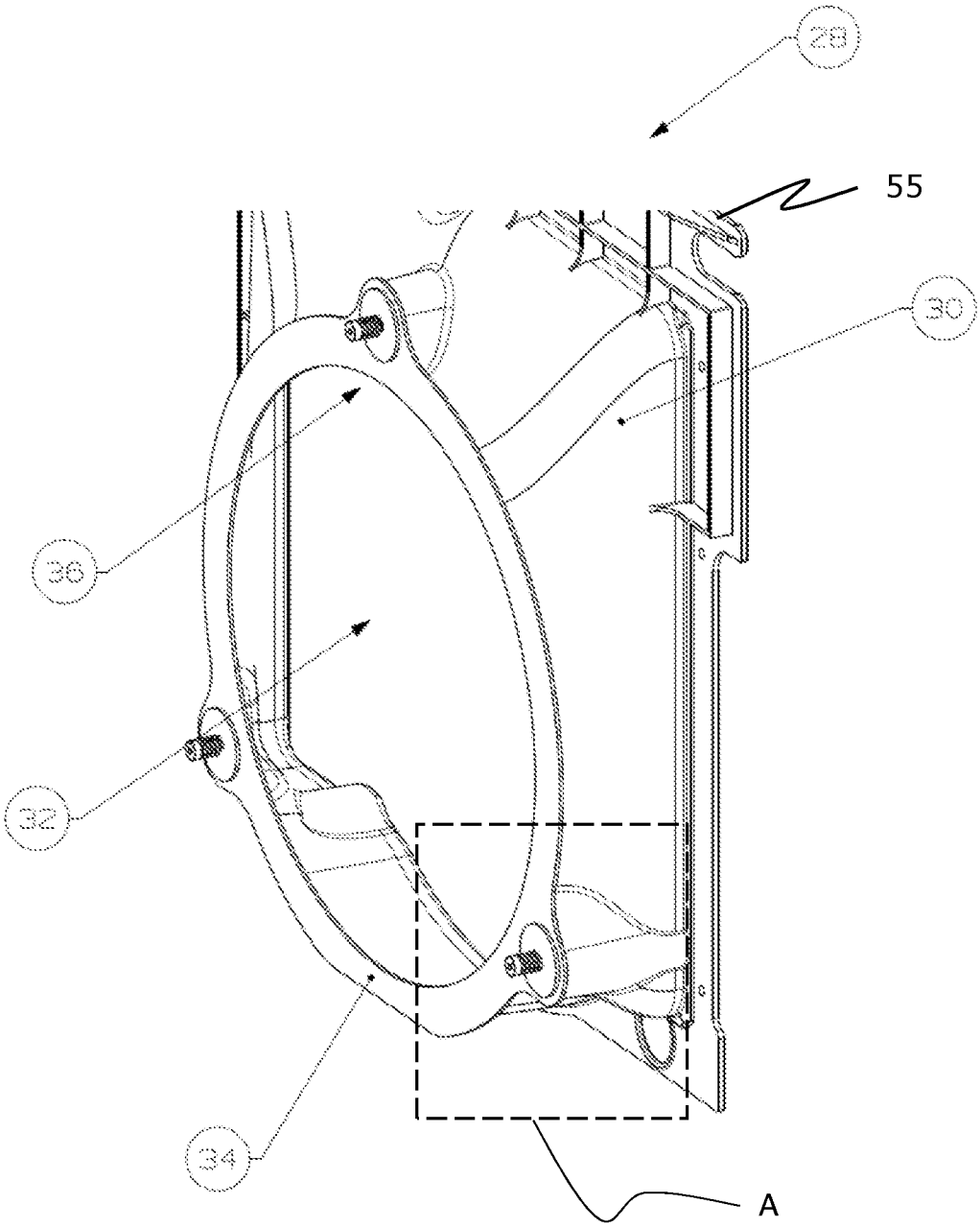
FIG. 2 is a fan cowling assembly according to an embodiment.

Referring now to FIG. 2, a fan cowling assembly 28 of a fan assembly is illustrated. The fan cowling assembly 28 is intended to be mounted to the working machine 10, e.g. for mounting within the engine compartment 26 of the working machine 10.

The fan cowling assembly 28 includes a shroud 30 forming part of a support (typically referred to as a bulkhead) 55 for mounting to a working machine 10. The shroud 30 defines an opening 32 for receiving the blades of a fan therein. In this embodiment the shroud 30 is integral with the bulkhead 55, but in other embodiments may not be the case.

A fan ring 34 is mounted to the shroud 30 by a ring mounting arrangement 36. The fan ring 34 is arranged so as to be positioned around the periphery of the opening 32. Put another way, the fan ring 34 is arranged to surround the blades of a fan, in use. It will be appreciated that the fan ring 34 is provided on the shroud 30 (i.e. as a part of the shroud 30 or as a component that is secured to the shroud 30) so as to define a substantially circular opening for surrounding the blades of a fan.

In the illustrated arrangement, the fan ring 34 is provided as a flat plate having a substantially circular inner edge which surrounds the blades of a fan. It will be appreciated that in alternative arrangements the fan ring 26 may not have a flat cross-sectional profile (i.e. it may not be a plate), and instead may have any suitable cross-sectional profile defining a substantially circular opening for surround the blades of a fan, such as a curved, circular or L-shaped cross-section.

It will further be appreciated that the fan ring 34 may be formed from two or more connectable parts in alternative arrangement and not as a unitary component as illustrated.

When the blades of a fan are positioned within the fan ring 34, sudden movements either of an engine to which the fan may be mounted of a working machine as a whole can result in relative movement between the fan blades and the fan ring 34. This relative movement can cause collisions between the fan blades and the fan ring 34. In order to minimize any damage which may be caused by these collisions, the ring mounting arrangement 36 is configured such that the fan ring 34 is moveable relative to the shroud 30 when mounted thereto. The moveable connection enables the fan ring 34 to be pushed out of the way by the colliding fan, in order to reduce the risk of damage occurring the fan ring 34 or the fan.

The ring mounting arrangement 36 is configured such that the position of the fan ring 34 is fixed relative to the shroud 30 unless an external force is applied. That is, the fan ring 34 is moveably mounted to the shroud 30 once an external force above a pre-determined threshold is exceeded. This configuration helps to reduce movement of the fan ring relative to the shroud during normal operation of the working machine 10 (e.g. movement of the fan ring 34 under its own weight). Put another way, the ring mounting arrangement 36 is configured such that the position of the fan ring 34 is fixed relative to the shroud 30 unless an external force above a pre-determined threshold is applied.

Upon contact between the blades of a fan and a part of the fan ring 34, the contacted part of the fan ring 34 moves away from the fan blades. This movement will result in an opposing part of the fan ring 34 to move towards the fan blades potentially resulting in a second contact between the fan blades and the fan ring 34. This works to re-center the fan ring 34 relative to the shroud 30. In testing this has been seen to be a gradual re-centering of the fan ring as the components settle to their rest positions.

Figure 3:
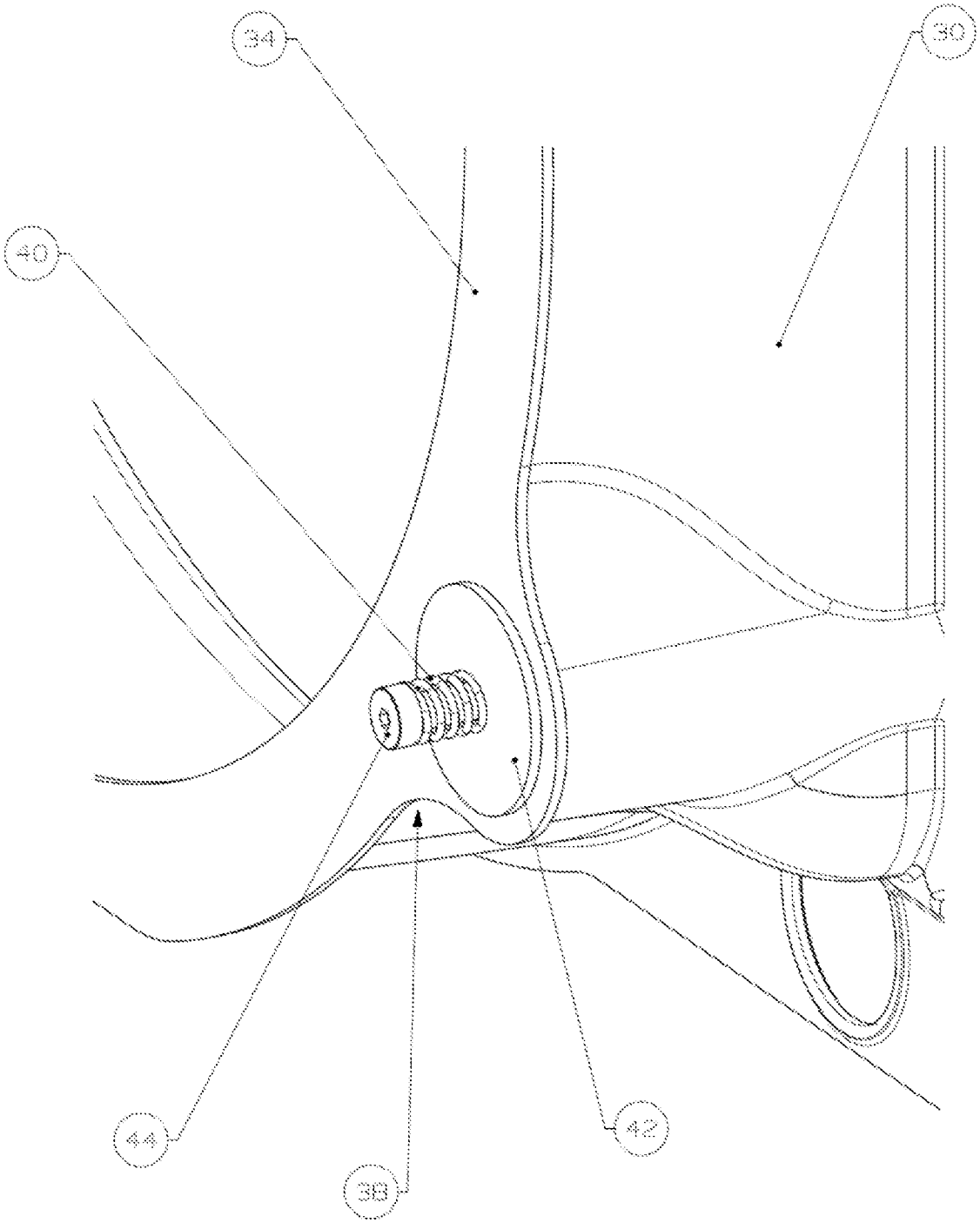
FIG. 3 is an enlarged view of portion A of the ring mounting arrangement of FIG. 2.
Figure 4:
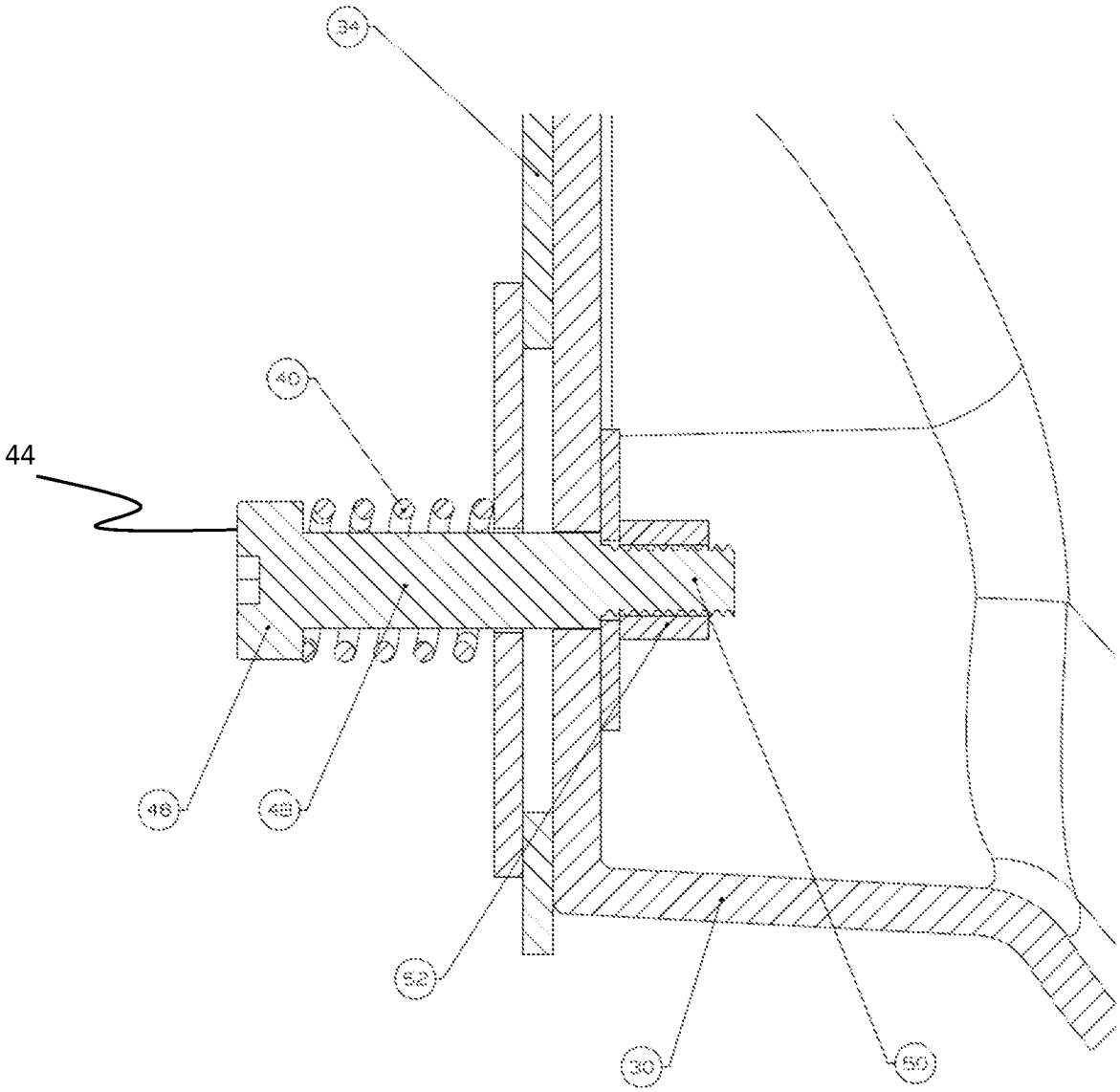
FIG. 4 is a cross-sectional side view of the ring mounting arrangement of FIG. 3.

Referring to FIGS. 3 and 4, the ring mounting arrangement 36 is illustrated in more detail.

The ring mounting arrangement 36 includes a biasing arrangement 38 configured to moveably and releasably mount the fan ring 34 to the shroud 30. In the arrangement shown, the ring mounting arrangement 36 includes a resilient element 40, e.g. a spring, for resiliently mounting the fan ring 34 to the shroud 30. This allows the preload of the fan ring 34 against the shroud 30 to be controlled, which also controls the frictional resistance to movement of the fan ring with respect to the shroud, and thus the force required to move the fan ring upon contact with the fan.

The biasing arrangement 38 is configured to urge the fan ring 34 into contact with the shroud 30. Put another way, the biasing arrangement 38 is configured to frictionally mount the fan ring 34 to the shroud 30.

In the arrangement shown, the ring mounting arrangement 36 is provided in the form a clamp. The ring mounting arrangement 36 includes a clamping member 42, e.g. in the form of a washer, and a portion of the fan ring 34 is interposed between said clamping member 42 and the shroud 30. In the embodiment, the biasing arrangement 38 applies a force to the clamping member 42 in order to clamp the fan ring 34 between the clamping member 42 and shroud 30.

Due to different tools or tool settings, different amounts of force could be applied during mounting of the fan ring 34 on to different working machines. This may result in inconsistency in the force applied by the ring mounting arrangement 36, which in turn may vary the amount of force needed to be applied in order to move the fan ring 34 relative to the shroud 30. Due to this, it will be appreciated that the ring mounting arrangement 36 may be configured such that the mounting force applied is pre-set prior to mounting the fan ring 34 to the shroud 30.

As discussed above, the ring mounting arrangement 36 may include a resilient element 40 for frictionally mounting the fan ring 34 to the shroud 30. In such arrangements, it will be appreciated that the mounting force applied to the fan ring 34 will be determined by the type of resilient element used and the degree by which it is compressed.

In the illustrated arrangement, the ring mounting arrangement 36 includes a shoulder fastener 44. The shoulder fastener 44 includes a head 46 at a first end thereof and a tubular portion 48 extending from the head 46. The cylindrical portion 48 has a threaded portion 50 that is spaced apart from the head 46. The threaded portion 50 is provided so as to secure the fastener 44 to the shroud 30 (i.e. into a threaded bore of a nut 52 mounted behind the shroud 30).

As is illustrated, the resilient element 40 extends along a portion of the elongate length of the shoulder fastener 44 (i.e. along a portion of the elongate length of the tubular portion 48). The resilient element 40 extends along the cylindrical portion 48 between the head 46 and the threaded portion 50. It will be appreciated that the compression of the resilient element 40 is determined by the spacing between the head 46 and the threaded portion 50 because the nut 52 cannot be tightened beyond the shoulder where the threaded portion and the cylindrical portion meet. This arrangement provides a consistent and repeatable compression of the resilient element 40, in which the mounting/biasing force applied for a given resilient element 40 is pre-determined.

Although the ring mounting arrangement has been discussed in terms of the shoulder fastener 44 and resilient element 40, it will be appreciated that alternative fasteners capable of mounting the fan ring 34 to the shroud 30 with a pre-determined force may be used, such as a fastener incorporating a torsion spring or a bent plate fastener arrangement. It will further be appreciated that in other embodiments, the fan ring may be mounted so as to self re-center after being displaced by contact with the fan e.g. by having a conical interface between the fan ring and shroud in conjunction with the fastener and resilient element.

It will be appreciated that the fan ring 34 may be moveable relative to the shroud 30 up to a pre-determined maximum distance. In the arrangement shown, the fan ring 34 is moveable relative to the shroud 30 by a distance in the range of 10 mm to 20 mm, for example approximately 15 mm.

Figure 5:
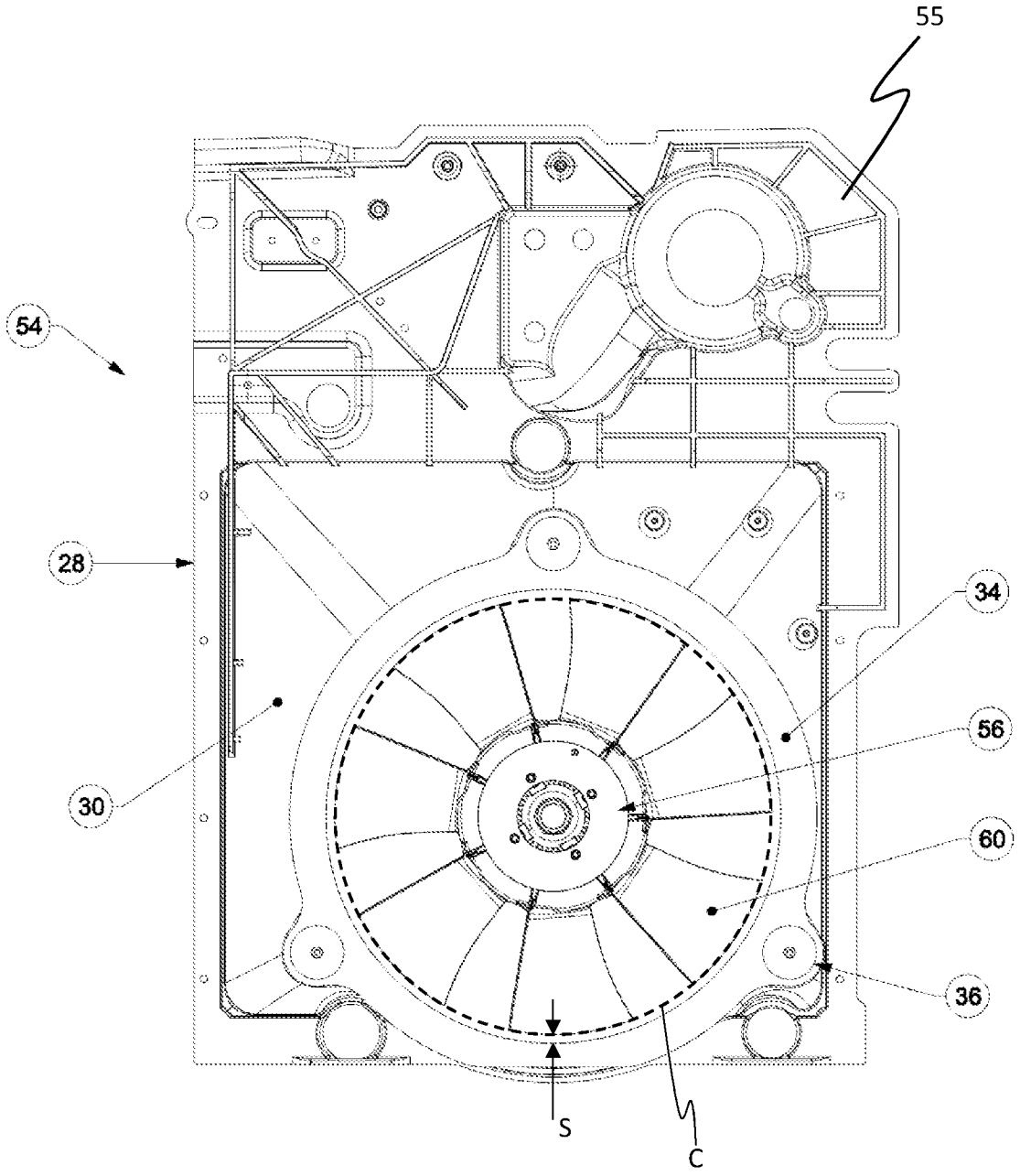
FIG. 5 is a front view of fan assembly according to an embodiment.

Referring now to FIG. 5, a fan assembly for cooling a working machine is illustrated and is indicated generally at 54. The fan assembly 54 includes a fan cowling assembly 28, as has been described with reference to FIGS. 2 to 4.

The fan assembly 54 further includes a fan 56. The fan 56 has a rotatable impeller in the form of a plurality of rotatable blades 60. In the arrangement shown, the fan 56 includes seven blades 60, but it will be appreciated that any suitable number of blades 60 may be used.

The fan 56 is also provided with a drive means for rotating the impeller. In the illustrated embodiment, the drive means is configured to be driven by an engine of a working machine 10, but in alternative arrangements the drive may be a hydraulic or electric motor, for example.

As is illustrated, the plurality of rotating blades 60 define an outer perimeter, as is indicated by the broken circle C. The fan assembly 54 is arranged so as to define a spacing between said outer perimeter 62 and a radially inner surface 64 of the fan ring 34. Providing a spacing S between the blades 60 and the fan ring 34 reduces the likelihood of collisions occurring. In the arrangement shown, the spacing is in the range of 6 mm to 10 mm, for example approximately 8 mm. Providing spacings in this range has been found to reduce the likelihood of collisions occurring between the fan ring and the fan blades, whilst maintaining a suitable air flow. It will be appreciated that in some embodiments the spacing may be reduced to be less than 6 mm, e.g. 3-4 mm, or increased to be more than 10 mm to meet particular installation requirements. Reductions may also be achieved as a result of the benefits arising from the present teachings. Where it is possible to reduce the spacing S this may be beneficial to the air flow characteristics of the fan cowling assembly.

Figure 6:
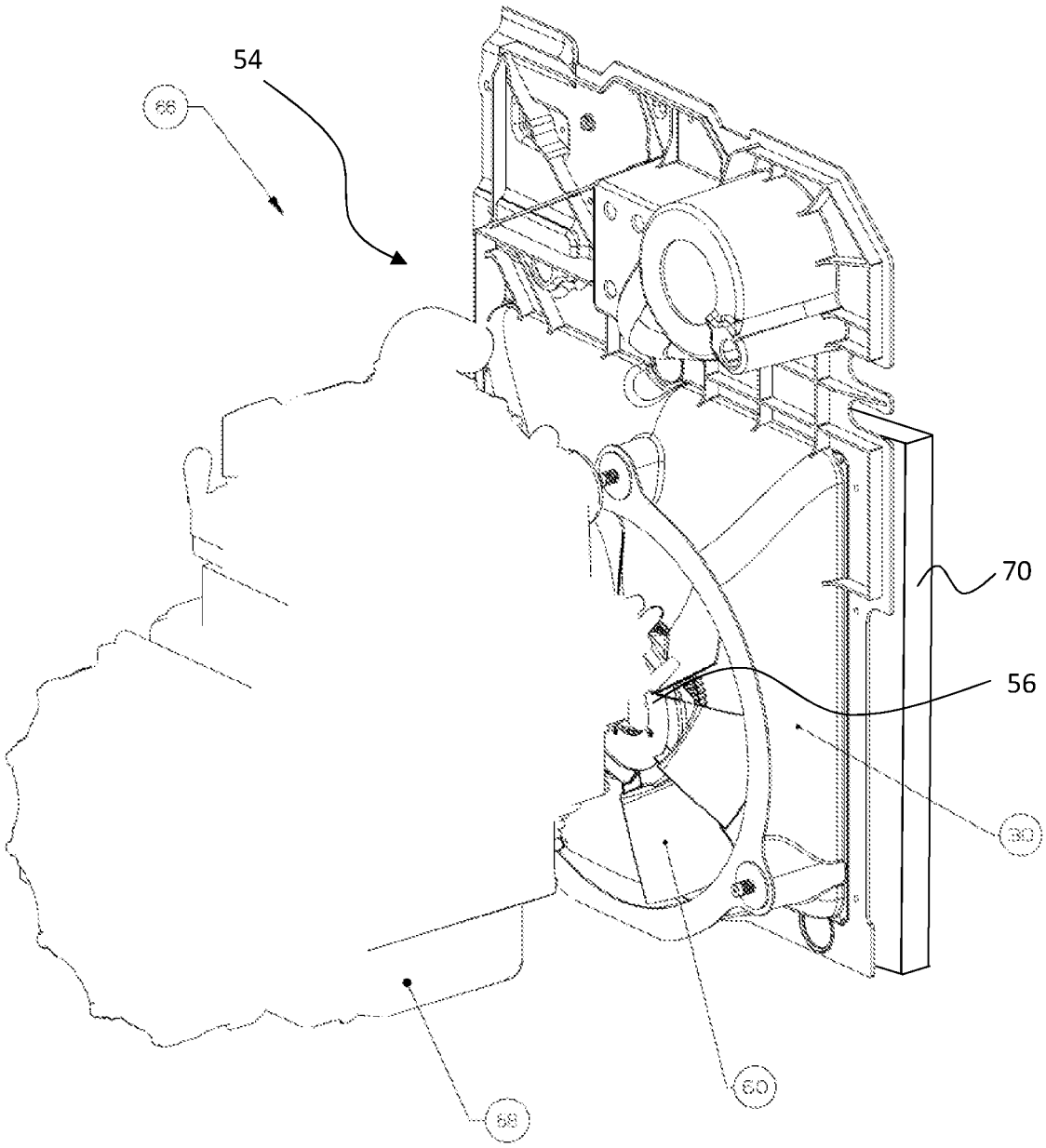
FIG. 6 is an isometric view of an engine assembly according to an embodiment.

Referring now to FIG. 6, an engine assembly for a working machine is illustrated and is indicated generally at 66. The engine assembly 66 includes a fan assembly 54 as has been described with reference to FIG. 5.

The engine assembly 66 further includes a prime mover 68, e.g. an internal combustion engine, and a heat exchanger 70 for cooling the prime mover 68. In use, the fan assembly 54 is configured to propel air over the heat exchanger 70 and over the prime mover 68 in order to cool the prime mover 68.

In the arrangement shown, the fan 56 is mounted to the prime mover 68 by a fan mounting arrangement (not shown). In some arrangements, the fan 56 may be mounted to the prime mover 68 by one or more anti-vibration mounts (not shown). In alternative arrangements, the fan 56 may not be mounted directly on to the prime mover 68, and may be mounted onto a different part or component of the working machine 10.

Figure 7:
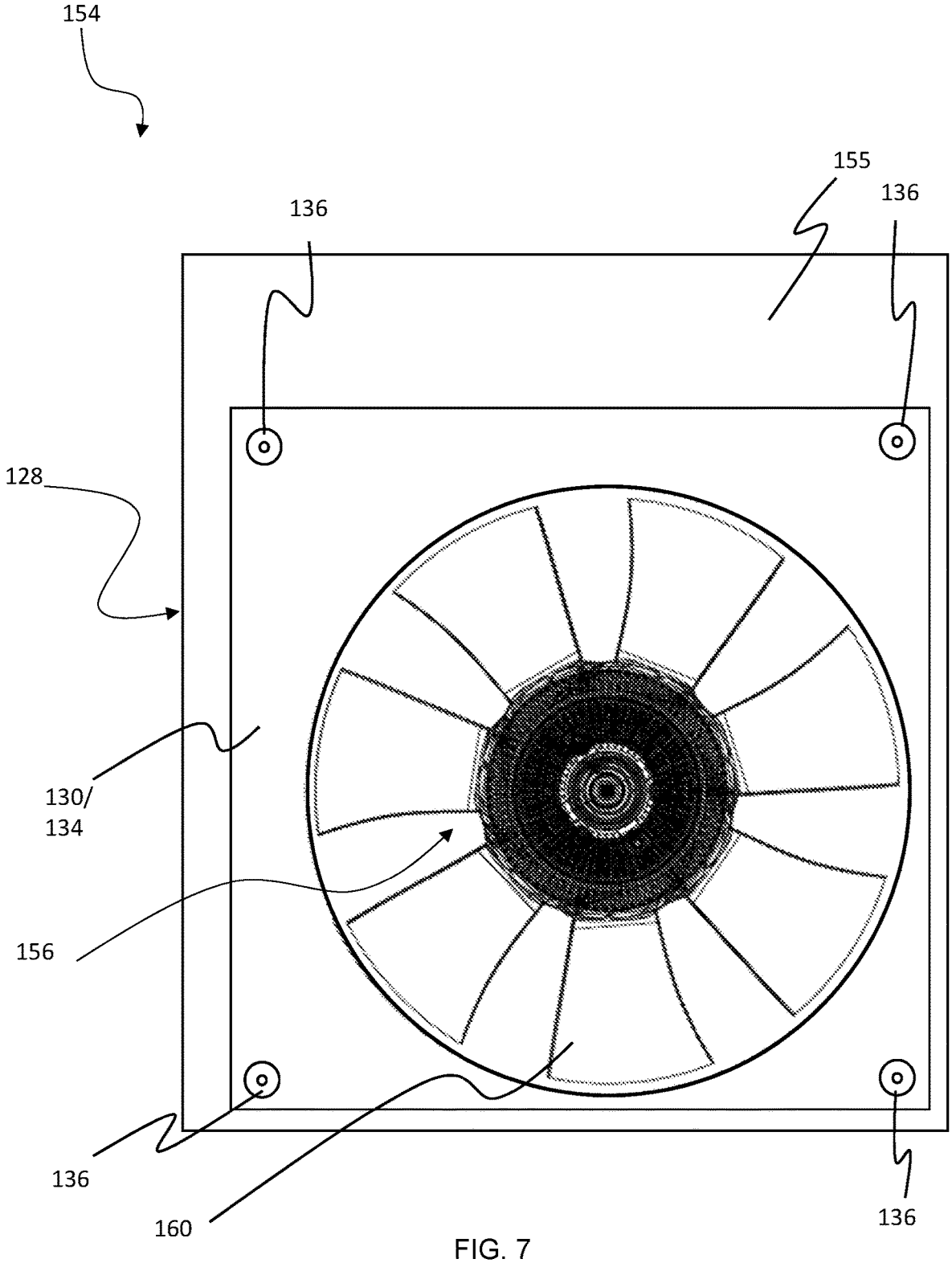
FIG. 7 is a simplified schematic view of a fan cowling assembly according to a further embodiment.

FIG. 7 illustrates another embodiment of the fan assembly. In this embodiment like parts are labelled by the same reference numerals used above, but with the addition of the prefix "1".

This embodiment differs from the previous embodiment in that the shroud 130 and fan ring 134 are integrally formed and mounted to the bulkhead 155 via ring mounting arrangements 136 similar to those 36 of the first embodiment. This enables the entire shroud 130 to move as required with respect to the bulkhead 155, in a similar way to that of the fan ring 34 with respect to the shroud 30 of the first embodiment. In other embodiments the fan ring and shroud may be separate components, but are secured together in a fixed spatial relationship.

Although the invention has been described in terms of a fan assembly for cooling a prime mover such as an engine, it will be appreciated that the cowling assembly and fan assembly are suitable for use in cooling any suitable component of a working machine such as required, such as a condenser of air conditioning unit.

The invention claimed is:

1. A fan cowling assembly for mounting to a working machine, the fan cowling assembly comprising:
- a support for mounting to a working machine, the support defining an opening for receiving a plurality of rotatable blades of a fan, in use;
- a fan ring mounted to the support by a ring mounting arrangement, the fan ring being arranged to surround the plurality of rotatable blades, in use;
- wherein the ring mounting arrangement comprises a fastener configured such that the fan ring is moveable relative to the support when mounted thereto; and
- wherein the fastener comprises a biasing arrangement configured to apply a pre-determined force to moveably connect the fan ring to the support.

2. A fan cowling assembly according to claim 1, wherein the ring mounting arrangement is configured such that the position of the fan ring is fixed relative to the support unless an external force is applied.

3. Fan cowling assembly according to claim 1, wherein the ring mounting arrangement is configured such that the position of the fan ring is fixed relative to the support unless an external force above a pre-determined threshold is applied.

4. Fan cowling assembly according claim 1, wherein the ring mounting arrangement is configured such that a force applied to mount the fan ring to the support is pre-set prior to installation of the fan ring.

5. A fan cowling assembly according to claim 1, wherein the support comprises a shroud, and wherein the fastener is configured to apply the pre-determined force to the shroud.

6. A fan cowling assembly according to claim 1, wherein the fan ring is resiliently mounted to the support.

7. A fan cowling assembly according to claim 1, wherein the fan ring is moveable relative to the support up to a pre-determined distance.

8. A fan cowling assembly according to claim 7, wherein the fan ring is moveable relative to the support by a distance in the range of 10 mm to 20 mm, for example approximately 15 mm.

9. A fan cowling assembly according to claim 1, wherein the support is defined by a bulkhead and a shroud, and the fan ring is moveably mounted to the shroud.

10. A fan cowling assembly according to claim 1, wherein the support is defined by bulkhead, the fan ring is fixed relative to a shroud and the shroud is moveably mounted relative to the bulkhead.

11. A fan cowling assembly according to claim 1, wherein the biasing arrangement is configured to frictionally mount the fan ring to the support.

12. A fan cowling assembly according to claim 1, wherein the biasing arrangement comprises a resilient element for biasing the fan ring into frictional engagement with the support.

13. A fan cowling assembly according to claim 1, wherein the biasing arrangement comprises a spring.

14. A fan cowling assembly according to claim 1, wherein the support comprises a shroud, and wherein the ring mounting arrangement comprises a clamping member and a portion of the fan ring is interposed between said clamping member and the shroud, and wherein the biasing arrangement is configured to clamp the fan ring between the clamping member and the support.

15. A fan cowling assembly according to claim 1, wherein the ring mounting arrangement comprises a shoulder fastener having a head at a first end thereof and a cylindrical portion extending from said head portion, the cylindrical portion having a threaded portion spaced apart from the head for securing the fastener to the support, wherein a resilient element extends between the head and the threaded portion for mounting the fan ring to the support.

16. A fan cowling assembly for mounting to a working machine, the fan cowling assembly comprising:
- a support for mounting to a working machine, the support comprising a shroud and defining an opening for receiving a plurality of rotatable blades of a fan, in use;
- a fan ring mounted to the support by a ring mounting arrangement, the fan ring being arranged to surround the plurality of rotatable blades, in use, wherein the ring mounting arrangement is configured such that the fan ring is moveable relative to the support when mounted thereto, wherein the fan ring mounting arrangement comprises a fastener configured to apply a pre-determined force to moveably mount the fan ring to the shroud.

17. A fan cowling assembly according to claim 16, wherein the fastener comprises a biasing arrangement configured to moveably connect the fan ring to the support via the shroud.

18. A fan cowling assembly according to claim 17, wherein the biasing arrangement is configured to frictionally mount the fan ring to the support via the shroud.

19. A fan cowling assembly for mounting to a working machine, the fan cowling assembly comprising:

a support for mounting to a working machine, the support defining an opening for receiving a plurality of rotatable blades of a fan, in use;

a fan ring mounted to the support by a ring mounting arrangement, the fan ring being arranged to surround the plurality of rotatable blades, in use;

wherein the ring mounting arrangement is configured such that the fan ring is moveable relative to the support when mounted thereto;

wherein the support comprises a shroud, and the fan ring mounting arrangement comprises a fastener configured to apply a pre-determined force to mount the fan ring to the shroud;

wherein the fan ring mounting arrangement further comprises a shoulder fastener having a head at a first end thereof and a cylindrical portion extending from said head portion, the cylindrical portion having a threaded portion spaced apart from the head for securing the fastener to the support, wherein a resilient element extends between the head and the threaded portion for mounting the fan ring to the support.

20. A fan cowling assembly for mounting to a working machine, the fan cowling assembly comprising:

a support for mounting to a working machine, the support defining an opening for receiving a plurality of rotatable blades of a fan, in use;

a fan ring mounted to the support by a ring mounting arrangement, the fan ring being arranged to surround the plurality of rotatable blades, in use;

wherein the ring mounting arrangement is configured such that the fan ring is moveable relative to the support when mounted thereto; and wherein the fan ring is moveable relative to the support up to a pre-determined distance in a range of about 10 mm to about 20 mm.

* * * * *